US006687926B1

(12) United States Patent
Bayley

(10) Patent No.: US 6,687,926 B1
(45) Date of Patent: Feb. 10, 2004

(54) WASTE AND OVERFLOW DRAIN ADAPTOR DEVICE

(75) Inventor: Jeff Bayley, Barrie (CA)

(73) Assignee: Canplas Industries Ltd., Barrie (CA)

( * ) Notice: Subject to any disclaimer, the term of this patent is extended or adjusted under 35 U.S.C. 154(b) by 468 days.

(21) Appl. No.: 08/891,351

(22) Filed: Jul. 10, 1997

(51) Int. Cl.[7] ..... E03C 1/28
(52) U.S. Cl. ..... 4/681
(58) Field of Search ..... 4/680–684, 252.5, 4/252.6

(56) References Cited

U.S. PATENT DOCUMENTS 938,102 A * 10/1909 Wise ..... 4/680
2,607,045 A 8/1952 Morris ..... 4/199
4,423,526 A * 1/1984 Izzi ..... 4/252.5
4,482,161 A * 11/1984 Izzi ..... 4/252.5 X
4,920,582 A 5/1990 Alker ..... 4/198

OTHER PUBLICATIONS

Dearborn Brass brochure, effective May 1, 1988.

* cited by examiner

*Primary Examiner*—Charles E. Phillips
(74) *Attorney, Agent, or Firm*—Hoffmann & Bacon, LLP

(57) ABSTRACT

An adaptor bushing for bathtub plumbing kits is disclosed. The bushing is adapted to be field securable into either a conventional sanitary tee or elbow fitting. In this way a kit is provided, having identical components, which may be connected in both a direct or indirect waste drain configuration, without any additional components being required.

8 Claims, 4 Drawing Sheets

WASTE AND OVERFLOW DRAIN ADAPTOR DEVICE

FIELD OF THE INVENTION

This invention relates to plumbing fittings, and in particular to plumbing fittings of the sort that are used in association with drains in residential, commercial and industrial plumbing. Most particularly, this invention relates to attachments to drains from water containing receptacles, such as bath tubs.

BACKGROUND OF THE INVENTION

Water containing receptacles are commonly used for temporarily storing water in residences for the purpose of bathing, washing or the like. An example of a common water containing receptacle found in every residence is a bath tub. Bath tubs typically include a plugable drain, located at the lowest point in the bath tub. When a person wishes to wash, the drain is plugged and the bathtub is filled with water. Once washing is completed, the drain is unplugged and the water is allowed to escape through the drain and into the drain plumbing. The drain plumbing carries the waste water to the sanitary sewer.

Most usually the bathtub is filled by means of a faucet which when open allows a mixture of hot and cold water to flow into the bathtub. Therefore, the bathtub is also usually provided with an overflow port or drain above the main drain. In the event the main drain is blocked, for example by a plug to fill the bath tub, overfilling of the bath tub is prevented by means of the overflow drain or port. Water will spill through the overflow drain at a level below the level of the rim of the bathtub, so the water does not end up spilling on the floor of the bathroom and causing damage.

In typical construction, the overflow drain will be connected to the same drainage pipe or plumbing as the main drain. This is accomplished with a series of fittings and short sections of pipe which are typically installed by plumbers. The most preferred form of connection is what is known as an indirect drainage connection. Beginning at the overflow drain, there are typically provided a 90° elbow and a short section of pipe, which are connected to a tee fitting, known as a sanitary tee fitting. The tee fitting has three openings, one of which extends downwardly and leads to a conventional P-trap and one which is oriented upwardly to attach to the short section of pipe coming from the overflow drain. The third opening extends horizontally and leads to a further 90° fitting or elbow located beneath the main drain of the bath tub. Typically, the elbow is provided with a threaded portion into which a basket or lift and turn plug mechanism can be inserted. In this manner, the main drain and overflow elbow can be directed through a sanitary tee to the plumbing piping leading to a conventional P-trap. The P-trap prevents harmful and malodorous sewer gasses from escaping up the piping into the residence through the open drains In certain circumstances however, the configuration of the subfloor obstacles including floor boards, beams, joists or the like, means that the preferred indirect drain connection cannot be made. There is simply not enough room. In such circumstances, the plumber may require a direct drain connection in which an overflow elbow is connected to the overflow drain, at one end, and has, at the other end, a short section of pipe extending downwardly. This pipe then connects to a non-threaded elbow to which another short section of pipe is attached extending to a sanitary tee. However, this sanitary tee includes a threaded portion at one end for receiving the basket strainer or lift and drop device of the drain. From there, a downwardly extending section of pipe connects the drain system to the conventional P-trap.

The direct waste and overflow configuration is less preferred, but, may be required in certain circumstances. However, the components used in the direct waste configuration are different from the components used in the indirect waste configuration. The indirect waste configuration requires a non-threaded sanitary tee connected to an elbow with a threaded portion. In contrast, the direct waste and overflow connection requires a threaded sanitary tee and a non-threaded elbow.

It would be unusual for a plumber to have on hand at the job site all of the components required to complete both direct and indirect plumbing configurations. As the indirect plumbing configuration is considerably more usual, threaded sanitary tees are not typically kept on hand by plumbers. In the presence of an awkward plumbing installation requiring such a direct connection, a plumber is often forced to cease work, return to the plumbing supply depot, purchase the specialty fitting, return to the job site and complete the job. This is awkward, time consuming, and, expensive.

In the past, there have been attempts to provide a universal waste and overflow drain assembly. In particular, U.S. Pat. No. 4,920,582 discloses a universal bath waste and overflow drain assembly which comprises an overflow to a drain pipe, a tee connector, and an adaptor which can be interchanged and interconnected as desired in different drain configurations according to the requirements of the particular job.

The adaptor is identified as number 18 in the drawings of this patent. In the direct waste configuration, shown in FIG. 2 of the patent, the adaptor is located above the combined elbow and drain pipe identified by 14. In the indirect waste configuration shown in FIG. 1, the adaptor is located above the tee connector. The adaptor taught is one which is externally threaded with a smooth internal bore. In FIG. 1, which shows the indirect waste configuration, the adaptor connects the overflow drain with the sanitary tee. The sanitary tee also includes the main drain connection. In the indirect waste configuration shown in FIG. 2, the adaptor interfaces with the 90° elbow and the sanitary tee is located directed beneath the main drain.

While generally suitable for components with threaded portions, this device is not readily adaptable to conventional plastic or PVC drain, waste and vent fittings. Such conventional fittings are formed without threads, and, are typically solvent welded together without even the use of O-ring seals or the like. Thus, the kit taught by this prior patent requires special fittings, typically made from metal, and allows non-threaded components to be sealed to threaded components. This requires expensive components and is fairly difficult and awkward to implement.

Additionally, adaptor fittings are known for connecting metal pipe components to plastic components, but such adaptor fittings typically are threaded for conventional pipe threads and are formed with a narrow rim which closely matches the fitting in outside diameter and is unsuitable for sealing large openings.

SUMMARY OF THE INVENTION

What is desired is a simple universal assembly which uses conventional and inexpensive plastic fittings and which is capable of being readily adapted to either the direct or the indirect drain waste overflow configurations without the need for any additional rare or unusual fittings. Most preferable, the components involved should be formed from plastic, and should be inexpensive and easy to use. Additionally, both the direct and the indirect waste drain configurations should be possible without needing to have on hand, or to go and locate, special or rare fittings required to complete the assembly.

Therefore, according to one aspect of the present invention, there is provided: a universal drain adaptor kit for use in association with a bath tub having a main drain opening and an overflow drain opening, the universal drain adaptor kit comprising a standard tee; an overflow elbow; a 90° elbow; and an adaptor bushing wherein said adaptor bushing has internal threads for receiving an externally threaded member and a smooth external wall adapted to be inserted into the smooth barrelled bells of at least either of said 90° elbow and said tee fitting.

In accordance with another aspect of the present invention there is provided an adaptor bushing for forming a universal adaptor kit for use in association with a bath tub having a main drain opening and an overflow opening, the adaptor bushing comprising: a generally tubular body being sized and shaped to be closely received within a barrel of a plumbing fitting, an internal threaded surface adapted to receive an externally threaded drain member in threaded engagement for retaining the threaded member in place relative to said bushing; a bondable exterior for bonding to the interior of said barrel of said plumbing fitting and a rim sized and shaped to fit around a main drain opening in a bathtub, wherein said adaptor bushing may be field secured into said plumbing fitting as required to suit field conditions.

BRIEF DESCRIPTION OF THE DRAWINGS

Reference will now be made to drawings which describe preferred embodiments of the invention, by way of example only, and in which.

DETAILED DESCRIPTION OF THE PREFERRED EMBODIMENTS

Figure 1:
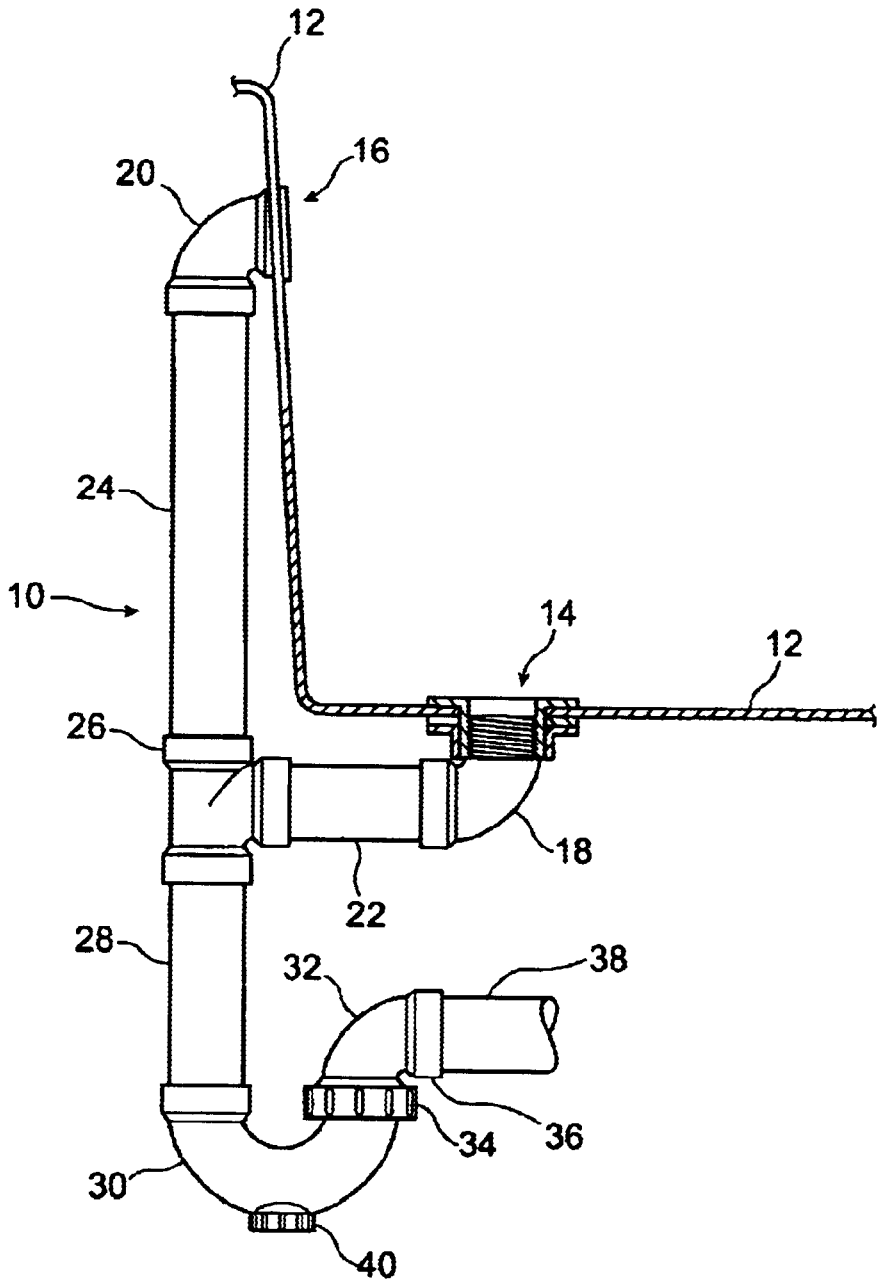
FIG. 1 is a view of the present invention showing an indirect drain connection configuration.
Figure 2:
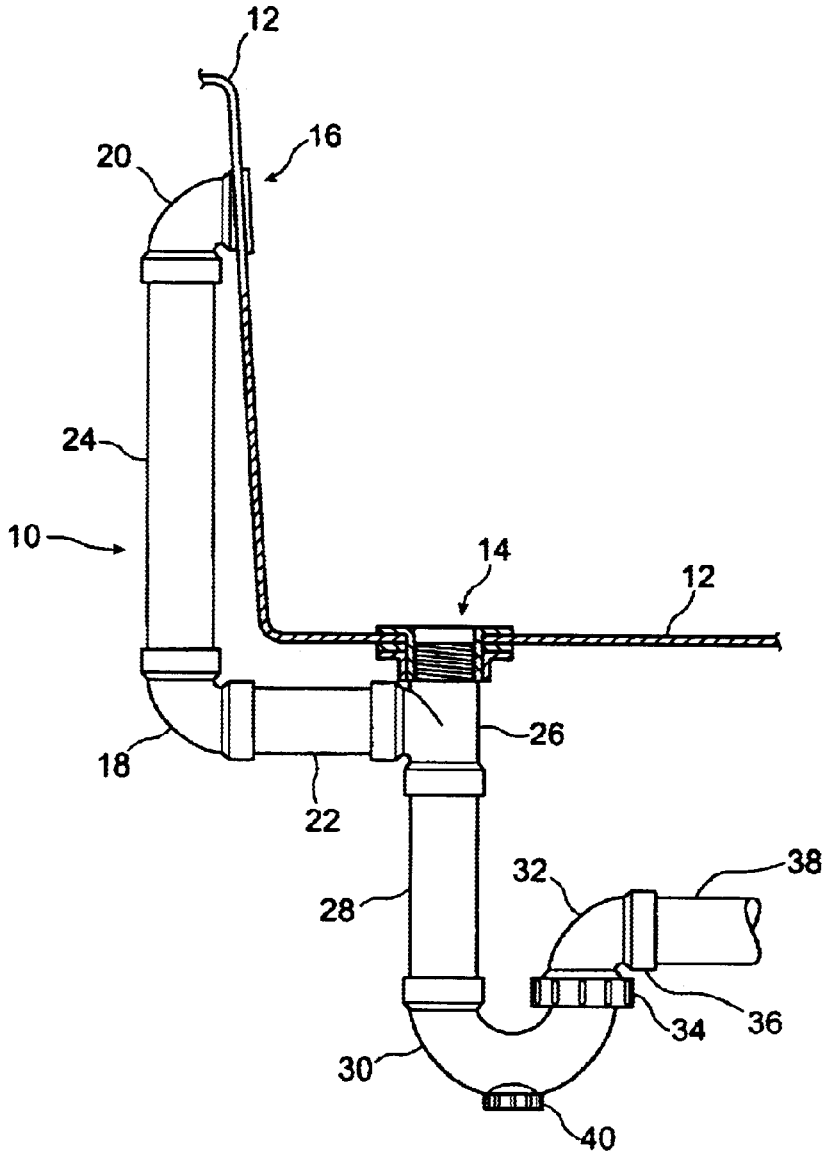
FIG. 2 is the invention of FIG. 1 shown connected in a direct waste and overflow configuration.

A universal drain adaptor kit as installed is indicated generally as 10 in FIGS. 1 and 2. The adaptor kit is shown installed in an indirect plumbing connection in FIG. 1, and in a direct plumbing connection configuration in FIG. 2.

Turning to FIG. 1, a bathtub is indicated schematically as 12 which includes a main drain opening 14 and an overflow opening 16. Extending below the main drain 14 is a first elbow 18 and extending behind the overflow opening 16 is a second elbow 20. Lengths of pipe 22 and 24 connect the first and second elbows respectively to a sanitary tee fitting 26. A further length of pipe 28 connects the sanitary tee fitting 26 to a P-trap 30. The P-trap 30 in turn is connected to an elbow 32 and may include a conventional nut and gasket arrangement shown at 34 and be provided with a bell at the other end 36 with a pipe 38 extending therefrom. The P-trap 30 also includes a releasable plug 40, as is known in the art, for allowing access to the P-trap 30 from below. It will be appreciated by those skilled in the art that there are various types of P-traps available and that the foregoing is an example of one type that has yielded satisfactory results. Others may be substituted as desired.

Turning to FIG. 2, like components are denoted with identical numbers for ease of understanding. Although connected in a different manner the components of FIG. 2 are the same as those for FIG. 1. For example, in FIG. 2 there is bathtub 12 which includes a main drain opening 14 and an overflow opening 16. Extending below the main drain is a sanitary tee fitting 26. Extending from the overflow drain 16 is an elbow 20 which connects to a length of pipe 22. Another elbow 18 connects to the other end of pipe 22. Extending from the other side of the elbow 18 is a second piece of pipe 24, which connects to the sanitary tee 26. A further length of pipe 28 connects the sanitary tee 26 to a conventional P-trap 30, which is identical to the P-trap described in relation to FIG. 1 above.

In both configurations the elements are the same. They are most preferably standard or conventional plumbing fittings made of thermoplastic or thermosetting resins, such as PVC or ABS. The pipe sections are sized and shaped to be closely received in the bells of the fittings where they can be field joined by solvent welding or the like. In this manner a liquid tight plumbing drain can be made.

In each of FIG. 1 and FIG. 2, there is also shown a lift and turn plug fitting 50, which is installed from the bathtub, after the drain assembly is completed by the plumber. The following description relates to one type of turn plug fitting 50, but others could also be used such as toe tap, plug and chain, mechanical linkage or the like. This fitting includes a conventional plug member 51 which may be lifted to an unplugged or draining position, and may be lowered to a plugged or bathtub filling position. The fitting 50 is typically formed from metal or the like and provides a clean decorative appearance to the finished bathtub.

Figure 3:
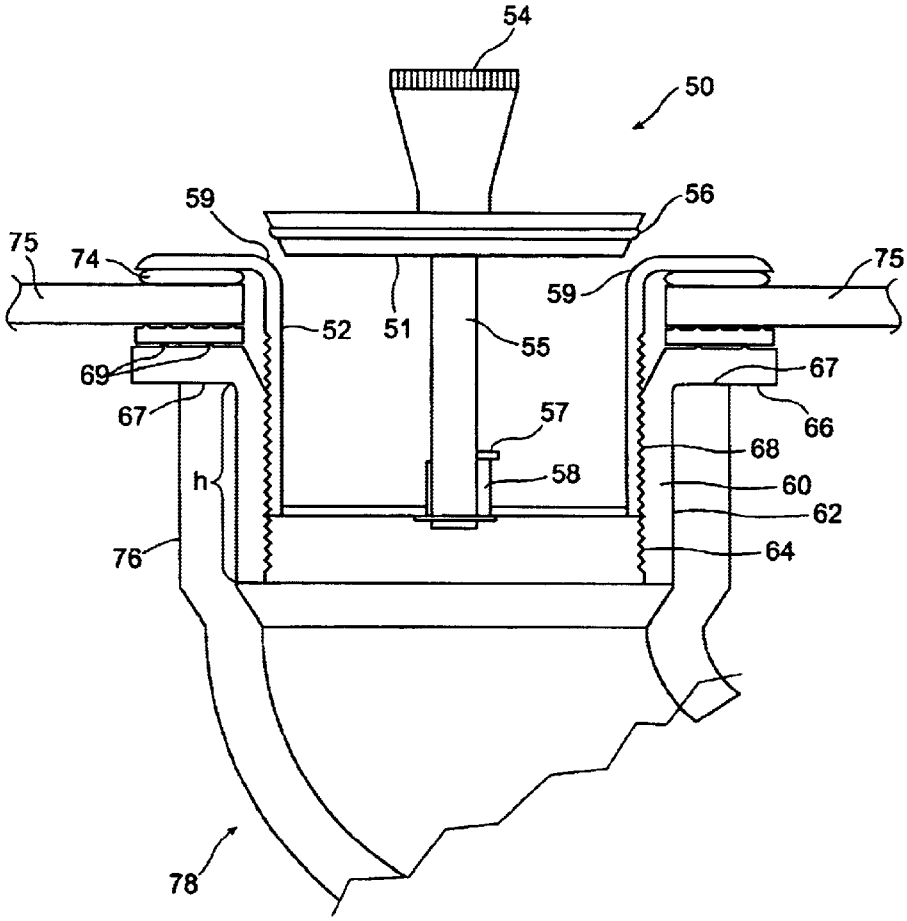
FIG. 3 is a close-up of a main drain connection using an adaptor according to the present invention.

As shown in FIG. 3, the fitting 50 includes a tubular main body 52 which houses the lift and turn plug element 51. The tubular main body is formed with external threads 53, for screwing the fitting into a mating plumbing fitting. The plug element 51 includes a knob 54, and a stem 55, as well as an O-ring seal 56. A small cam 57 rests on a partial sleeve 58, to allow the plug element to stay in the raised position. By rotating the knob 54, the cam 57 slides off the sleeve 58, permitting the plug element 51, and in particular O-ring seal 56 to seal against inclined side edges 59 of the fitting 50.

Thus, until the present invention it has been necessary to have a sanitary tee with one end plain, for accepting a section of pipe and one end threaded, for accepting a fitting 50, in order to complete a direct drain configuration. Of course, the middle bell or socket will be non-threaded or plain also. Similarly it was necessary in the past to have elbows with one end plain to accept a pipe in the bell and the other end threaded to accept the fitting 50, for an indirect drain connection.

Figure 5:
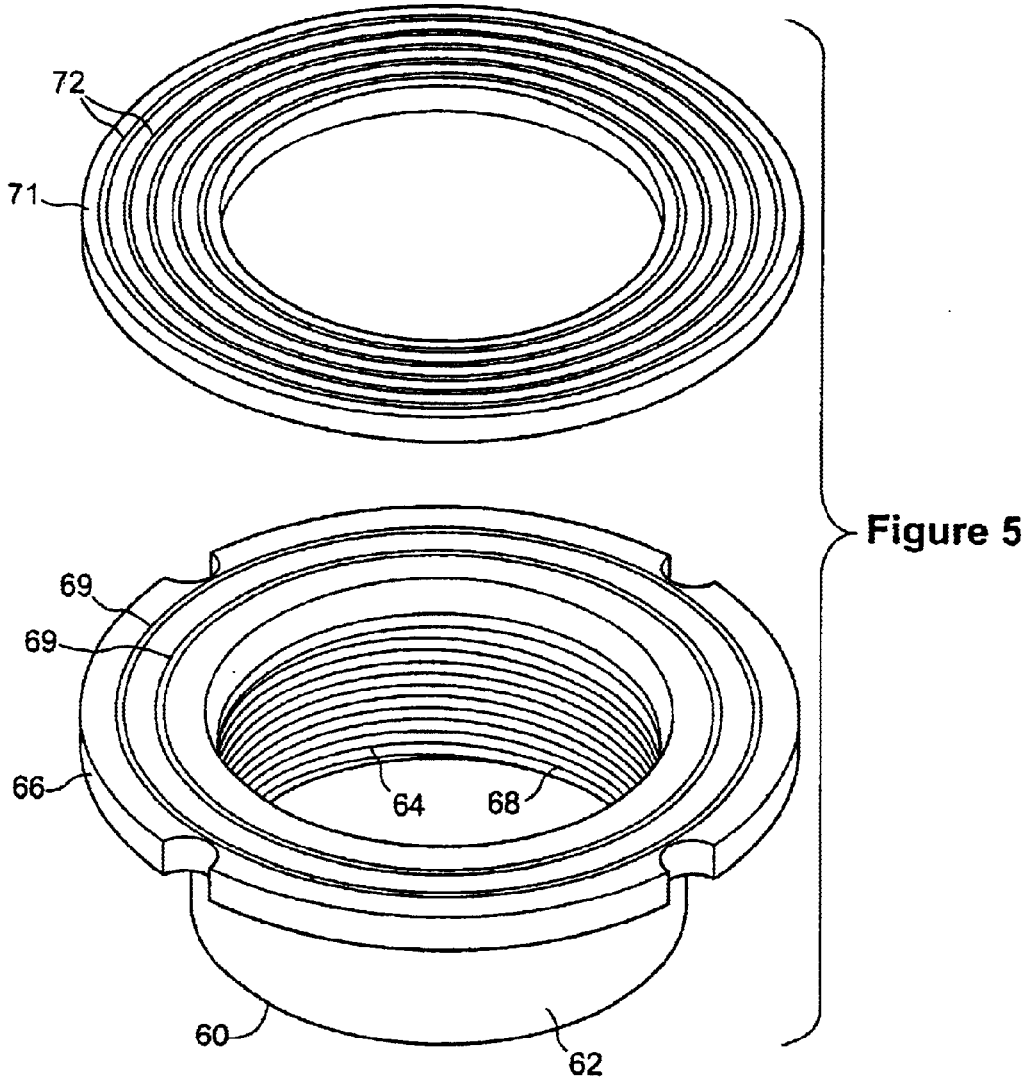
FIG. 5 is a perspective view of the adaptor and a gasket according to the present invention.
Figure 4:
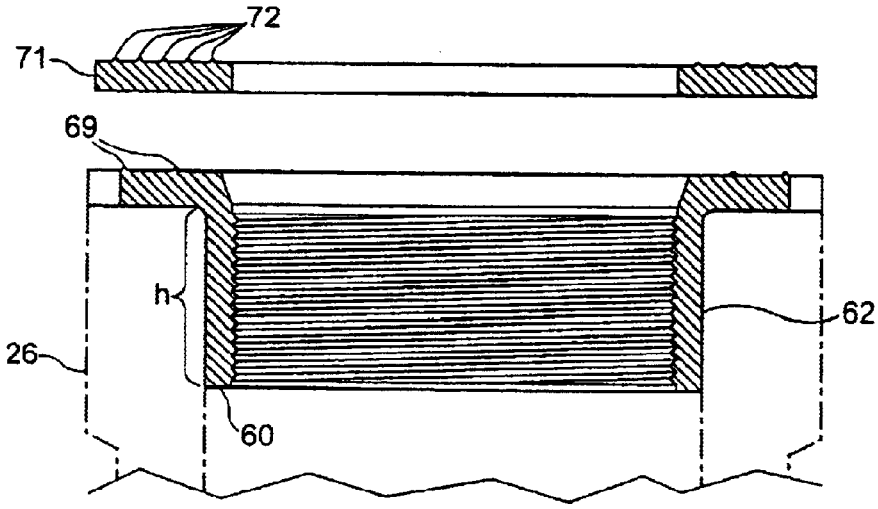
FIG. 4 is a cross-sectional view of the adaptor.

It can now be appreciated how the present invention overcomes these problems. The present invention is directed to an adaptor bushing, which is in the form of a tubular body shown as 60 in FIGS. 4 and 5. The tubular body 60 includes an outer surface 62 and an inner surface 64. A mounting rim 66 is also provided. The outer surface 62 of the body 60 is tubular and is sized and shaped to fit into the standard bell of conventional plumbing fittings. In this sense it is dimensioned to be closely received within the bells of both of, for example, the sanitary tee 26 shown in ghost outline in FIG. 4 or the elbow 20.

Most preferably the body 60 is formed from a thermoplastic or thermoset resin which is compatible with the plastic of the conventional fittings, such as PVC, and thus may be readily field secured into the fitting by the appropriate application of conventional plastic welding solvents or the like. It can now be appreciated why the most preferred form of the invention is with a smooth outer surface 62. In the first place a smooth outer surface 62 increases and maximizes the surface area of the adaptor fitting and the bell of the fitting having surface contact. In this manner a secure solvent weld can be made with a maximum amount of bonded surface to enhance the strength of the joint. As well such a larger contact surface area increases the likelihood that any joint formed between the adaptor fitting and the other fitting will be liquid tight. However, as will be appreciated by those skilled in the art, there are many other types of interengagement that are possible between the adaptor fitting and the bell of the fitting. Any that provide a liquid tight, field securable, joint will be acceptable.

Since the desire is to make the adaptor fitting easily insertable into conventional plumbing fittings a smooth outer surface 62 is preferred but other types of outer surface may also achieve the same function of being able to be secured into the bell of a fitting. For example there may be provided a series of raised rings, spirals or other surface features which are on the one hand not smooth, but on the other hand still allow the adaptor fitting to be secured into the bell of a fitting. Other surface features may be provided to form a solventless connection, but these would require a matching interengaging means on the inside of the bell of the fitting, which would require specialty fittings and thus are less preferred.

The inner surface 64 of the fitting 60 is provided with threads 68, which according to the most preferred form of the present invention are adapted to threadingly engage the external threads 53 of the fitting 50. Thus once the adaptor bushing 60 is secured into the fitting 20 or 26, the fitting 50, with the lift and turn plug 52 can be threaded into the adaptor bushing 60 to complete the installation.

For example, FIG. 3 shows the adaptor bushing 60 installed in an attachment bell 76 of a fitting 78. The bathtub floor 75 is also shown. Between the underside of the floor 75 and the adaptor bushing rim 66 is provided a rubber gasket 71. Most preferably the gasket 71 includes ridges 72 for better sealing and is compressible to form a good seal. Also shown is plumber's putty 74 between the fitting 50 and a top surface of the floor 75. Although FIG. 3 illustrates an elbow fitting 78, it will now be appreciated that the fitting could also easily be a tee-fitting having an identically dimensioned attachment bell as 76.

It will be appreciated that the adaptor bushing rim 66 is formed with a significant overhang. In this manner enough surface area is provided on the top side of the rim 66 to allow the rim to be sealed against various sized main drain openings. Each manufacturer of bathtubs has a slightly different tolerance, so even tubs having the same nominal drain hole will have variations in practice. What is required is that the rim 66 extend out from the body enough so that it is sized and shaped to seal around main drain openings of conventional tubs. Preferably the rim extends more than twice the wall thickness of the adaptor and most preferably about three times the wall thickness.

Thus the present invention is used as follows. First, the installer inspects the space under the bathtub to determine what type of drain connection is to be made. Then the installer will plumb the drain components together. During this step the installer will insert the adaptor bushing into an appropriate fitting and weld it or otherwise secure it in place. Then, from inside the bathtub, the cover plate for the overflow drain and the lift and turn or other drain insert are connected to the plumbing through the preformed holes in the bathtub. The drain plumbing is essentially clamped onto the bathtub with the rim sealing around the drain hole, as the drain fitting is threaded into the adaptor bushing. In this way, the adaptor bushing-fitting combination will be secured to the tub. Then the outlet of the waste and overflow drain would be connected to the DWV system via a P-trap.

It can also now be appreciated that the mounting rim 66 is formed on the body of the adaptor bushing 60 in a way that permits the adaptor bushing to be drawn up tightly onto the underside of the bathtub when the fitting 50 is threaded therein. Thus, the height of the external surface 62 is sufficient to allow the adaptor bushing 60 to be fully inserted into the fitting 20 or 26 without any interference from the mounting rim 66. Most preferably, when the external surface 62 of the adaptor bushing 60 is fully inserted into the bell of a fitting, the underside of the mounting rim 66 will just contact the lip 67 of the end of the bell of the fitting.

It is also preferred to include one or more raised ribs 69 on the top or outer face of the mounting rim 66 to facilitate the formation of a good stable grip on the bottom or outer surface of the tub. The ribs 69 can mate with the gasket 71 ribs to help keep the bell in place. It will also be appreciated that mounting rim 66 should be made strong enough to accommodated the forces that it becomes subjected to when the fitting 50 is screwed into the adaptor bushing 60 and the combined assembly is thereby clamped onto the bathtub.

In some cases it may be preferred to use the rubber gasket 71 to protect the bathtub from excessive point loading which otherwise may occur during the action of threading the fitting 50 into the adaptor bushing 60. As will be familiar to those skilled in the art, the bathtub is typically formed from a porcelain material or the like which while strong and durable is quite brittle. Thus by placing a rubber or elastomeric gasket, such as shown at 71 with one or more with sealing ribs 72, the porcelain can be protected. Of course, conventional plumbers'putty 74 can also be used to provide an adequate seal without the need for over tightening and risking breaking the ceramic.

It will be appreciated by those skilled in the art that various modifications and alterations can be made to the present invention without departing from the broad scope of the invention as defined by the appended claims. Some of these modifications and variations have been discussed above and others will be apparent. For example, although reference has been made to a smooth barrel on the outer surface of the adaptor bushing 60, what is really required is that the outer barrel be sized and shaped in a manner that the barrel can be secured into the bell of a standard plastic plumbing fitting, such as an elbow or a sanitary tee, tee wye, wye and ⅛ bend or the like. Further, while reference has been made to an internal threaded bore, other interengaging means between the lift and drop drain fitting 50 and the internal bore of the adaptor fitting 60 could also be used provided that a secure clamping action onto the bottom of the tub around the drain hole is achieved.

I claim:

1. A universal drain adaptor kit for use in association with a bath tub having a main drain opening and an overflow drain opening, the universal drain adaptor kit comprising:

a thermoplastic tee fitting having an attachment bell;

an overflow elbow;

a thermoplastic 90° elbow fitting having an attachment bell;

and an adaptor bushing, said adaptor bushing having:

internal interengaging means for receiving and securing a drain fitting therein, an external surface sized and shaped to be secured to either of the attachment bells of said 90° elbow and said tee fitting, and a rim sized and shaped to fit around said main drain opening in said bathtub, wherein said kit when combined with drainage piping can be configured to form either a direct or an indirect drainage attachment for said bathtub.

2. The kit of claim 1 further including one or more sections of plastic pipe for connecting said fittings together.

3. The kit of claim 2 wherein each of said fittings include attachment bells of a standard size, wherein said sections of plastic pipe can be sealed therein.

4. The kit of claim 1 wherein said adaptor bushing has a height, between a lower end and an underside of said rim, said height being of a predetermined size to be fitted within an attachment bell of either of said tee fitting or said elbow fitting wherein said rim is closely adjacent to an external lip of either of said attachment bells.

5. The kit of claim 4 wherein said rim is formed with at least one raised ridge to facilitate sealing against water leakage.

6. The kit of claim 5 wherein said kit further includes a sealing means and a drain fitting.

7. The kit of claim 6 wherein said sealing means is a rubber gasket.

8. The kit of claim 6 wherein said inter-engaging means comprises a threaded surface, which is sized and shaped to receive a threaded drain fitting.

* * * * *